US006633263B2

(12) United States Patent
Bettin et al.

(10) Patent No.: US 6,633,263 B2
(45) Date of Patent: Oct. 14, 2003

(54) ANTENNA FOR RECEIVING SATELLITE SIGNALS AND TERRESTRIAL SIGNALS AND ANTENNA MODIFICATION DEVICE

(75) Inventors: Ulrich Bettin, Berlin (DE); Heinz Gerhaeuser, Waischenfeld (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 10/090,402

(22) Filed: Mar. 4, 2002

(65) Prior Publication Data

US 2002/0089460 A1 Jul. 11, 2002

Related U.S. Application Data

(63) Continuation of application No. PCT/EP00/03293, filed on Apr. 12, 2000.

(51) Int. Cl.[7] ..... H01Q 9/30
(52) U.S. Cl. ..... 343/725; 343/833
(58) Field of Search ..... 343/725, 795, 343/806, 793, 895, 801, 803, 802, 815, 822, 830, 831, 715, 856, 729, 833, 727

(56) References Cited

U.S. PATENT DOCUMENTS

| | | | | |
|---|---|---|---|---|
| 4,479,130 A | * | 10/1984 | Snyder | 343/802 |
| 5,173,713 A | | 12/1992 | Yves et al. | 343/749 |
| 5,307,078 A | | 4/1994 | Tanaka et al. | 343/791 |
| 5,798,736 A | * | 8/1998 | Hall | 343/791 |
| 5,977,920 A | * | 11/1999 | Hung | 343/715 |
| 6,337,667 B1 | * | 1/2002 | Ayala et al. | 343/795 |

FOREIGN PATENT DOCUMENTS

| | | | |
|---|---|---|---|
| DE | 3826777 A1 | 2/1990 | H01Q/21/30 |
| GB | 2148604 A | 10/1983 | H01Q/9/30 |
| GB | 2306252 A | 10/1995 | H01Q/9/30 |
| JP | 11308038 A | 11/1999 | H01Q/9/30 |

* cited by examiner

*Primary Examiner*—James Clinger
(74) *Attorney, Agent, or Firm*—Gardner Groff, P.C.

(57) ABSTRACT

An antenna for receiving satellite signals and terrestrial signals comprises a monopole having a first end, which is connected to a feeding point, and a second end, and an unfed dipole which is arranged in spaced relationship with the second end of the monopole and in axial alignment with said monopole. By means of this arrangement a maximum antenna gain lying at an elevation angle of approx. 45° is achieved. An antenna modification device comprises a dipole and a connection element by means of which the dipole can be connected to the end of an existing monopole antenna in such a way that the dipole is unfed and arranged in spaced relationship with the second end of the monopole as well as in axial alignment with the monopole.

9 Claims, 2 Drawing Sheets

ANTENNA FOR RECEIVING SATELLITE SIGNALS AND TERRESTRIAL SIGNALS AND ANTENNA MODIFICATION DEVICE

CROSS-REFERENCE TO RELATED APPLICATIONS

This application claims priority to is a continuation of, and is a National Phase filing of, PCT Application Serial No. PCT/EP00/03293, filed Apr. 12, 2000, which claims priority to German Patent Application No. 19944505.2 filed Sep. 19, 1999.

BACKGROUND OF THE INVENTION

1. Field of the Invention

The present invention relates to an antenna and especially to a universal antenna for receiving satellite signals and terrestrial signals, which is particularly suitable for mobile use. Furthermore, the present invention relates to an antenna modification device for modifying an existing monopole antenna.

2. Description of Prior Art

Quite recently, an increasing number of services have been making use of geostationary satellites for broadcasting radio signals, television signals or other signals. There is a tendency to realize hybrid solutions, i.e. systems in which the signals are broadcast simultaneously via satellite as well as via terrestrial transmitters. By means of this course of action, the advantages of both variants can be combined.

Since, in comparison with signals broadcast by terrestrial transmitters, the received field strengths of satellite signals are much weaker, great store should be set by a maximum antenna gain in the direction of the satellite when the receiving antenna is designed and constructed concretely. In the northern hemisphere the elevation angle between a receiving antenna and geostationary satellites ranges e.g. from 30° to 60°, depending on the parallel of latitude on which the receiving antenna is located. When signals are received, which are broadcast via geostationary satellites, the gain maximum of the receiving antenna should therefore be about 45°.

Conventional vertical antennas for mobile reception, which are referred to as so-called rod antennas, e.g. the classical $\lambda/4$ monopole, have, due to the nature of the system, a theoretical zero point at an elevation angle of 90° and an angle theta of 0°, respectively. Due to the influence of a finite electric conductivity and losses in the metallic surface area, e.g. the roof of the vehicle, the gain maximum of these antennas is at an elevation angle of from 10° to 35°. When an elevation angle of 35° is exceeded, the antenna gain decreases rapidly, whereby the system reserve will be reduced markedly in the case of reception via a satellite. This may, however, result in reception losses. It follows that conventional vehicle antennas are not suitable for receiving terrestrial signals and satellite signals in common.

SUMMARY OF THE INVENTION

It is the object of the present invention to provide an antenna for receiving satellite signals and terrestrial signals in the case of which reception losses can be avoided when receiving signals via satellite and to provide an antenna modification device for modifying existing monopole antennas, which permits existing monopole antennas to be modified such that reception losses can be eliminated or reduced when receiving signals via satellite.

According to a first aspect of the present invention this object is achieved by an antenna for receiving satellite signals and terrestrial signals, the antenna comprising a monopole having a first end, which is connected to a feeding point, and a second end. The antenna additionally comprises an unfed dipole which is arranged in spaced relationship with the second end of the monopole and in axial alignment with the monopole and which contributes to the directional pattern of the antenna via a field coupling.

In accordance with preferred embodiments of the present invention, the monopole is a $\lambda/4$ monopole, whereas the dipole has a length in the range from $\lambda/2-25\%$ to $\lambda/2+25\%$. Furthermore, the distance between the monopole and the dipole is preferably smaller than $\lambda/10$. Due to the arrangement of the monopole and of the unfed dipole according to the present invention, the dipole contributes, as a mere passive element, via a field coupling to the resultant directional pattern, i.e. to the far-field pattern, of the antenna. The resultant directional pattern shows a gain maximum in the range of an elevation angle of 45°. It follows that the antenna according to the present invention is excellently suitable for receiving signals broadcast via geostationary satellites so that reception losses can be eliminated or reduced.

In accordance with a second aspect of the present invention the above object is achieved by an antenna modification device for modifying a monopole antenna having a first end, which is connected to a feeding point, and a second end, the antenna modification device comprising a dipole and a connection element. The connection element serves to connect the dipole and the monopole such that the dipole is unfed and arranged in spaced relationship with the second end of the monopole as well as in axial alignment with the monopole, said dipole contributing to the directional pattern of the antenna via a field coupling.

It follows that the present invention permits existing monopole antennas to be modified so as to be able to realize reception via a satellite without considerable reception losses.

BRIEF DESCRIPTION OF THE DRAWINGS

In the following preferred embodiments of the present invention will be explained in detail making reference to the drawings enclosed, in which.

DESCRIPTION OF PREFERRED EMBODIMENTS OF THE INVENTION

Figure 1:
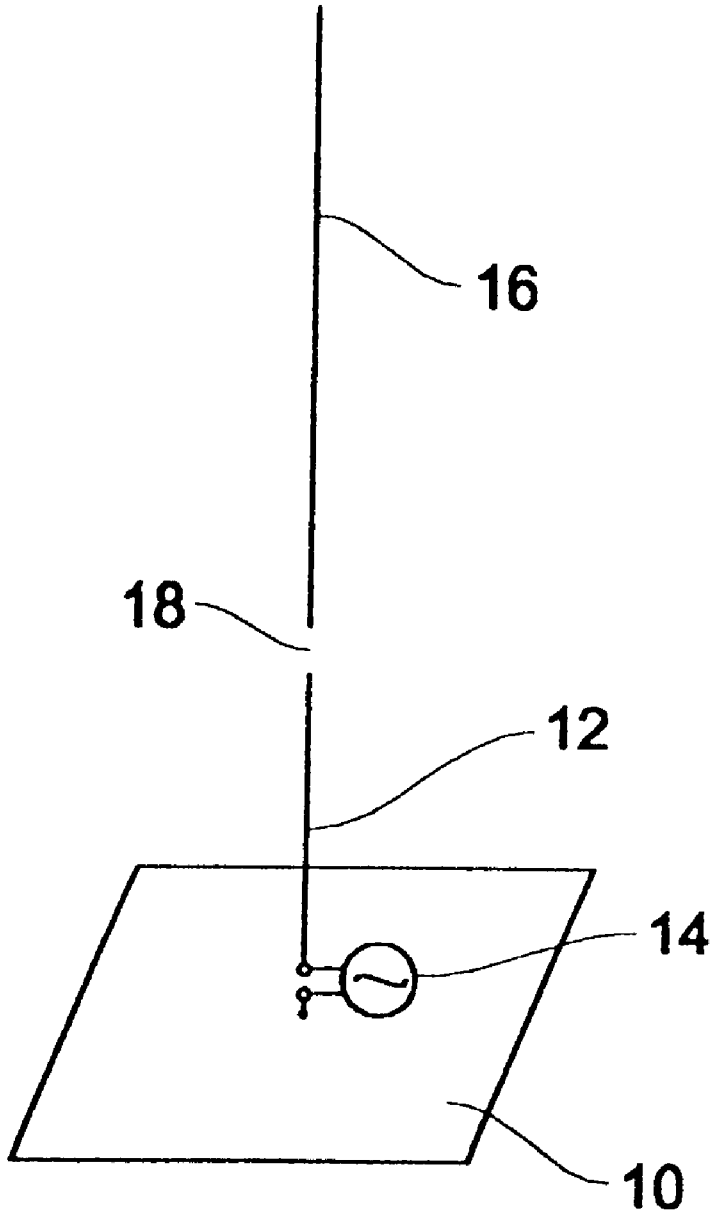
FIG. 1 shows a schematic representation of an embodiment of an antenna according to the present invention used for receiving satellite signals and terrestrial signals.

Making reference to FIG. 1, the fundamental structural design of a universal antenna for the mobile reception of satellite and terrestrial signals will now be explained in detail; this kind of antenna can be attached e.g. to the roof of a vehicle. The antenna is preferably attached to a conductive surface area, e.g. the roof 10 of a vehicle. A monopole 12, which is preferably a $\lambda/4$ monopole, is connected to a feeding point 14 at its base where it is attached to the vehicle roof 10. The feeding point 14 is e.g. a coaxial connection. In accordance with the present invention, a dipole 16 is arranged in spaced relationship with the second end of the monopole 12 and in axial alignment with the monopole 12, a distance 18 being provided between the monopole 12 and the dipole 16. The length of the dipole is preferably between $\lambda/2$ minus 25% and $\lambda/2$ plus 25%, $\lambda$ being the wavelength associated with the frequency of the signals to be received. In the most preferred case, the length of the dipole 16 is λ/2. The distance 18 between the monopole 12 and the dipole 16 is preferably shorter than λ/10.

Figure 2:
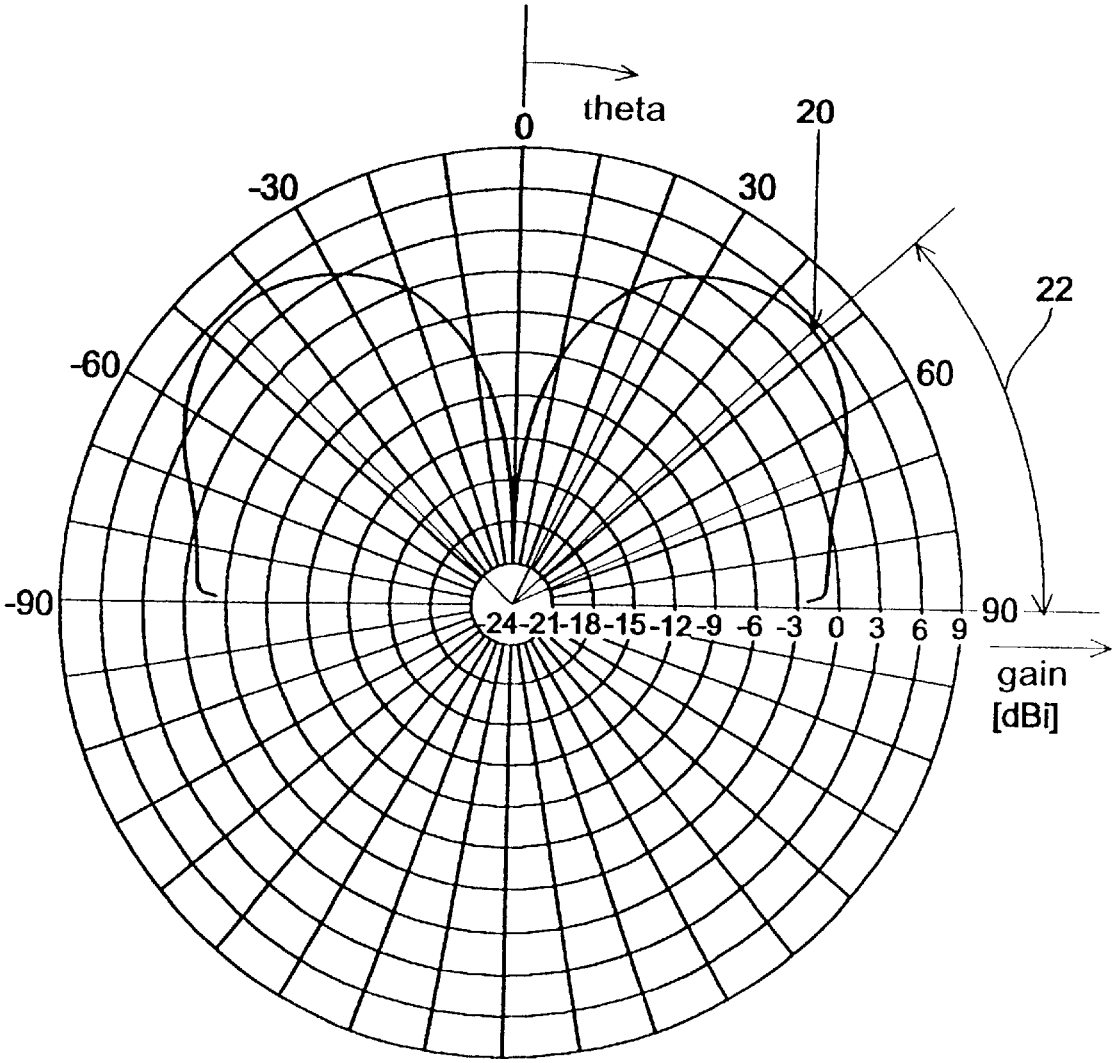
FIG. 2 shows a directional pattern of the antenna shown in FIG. 1.

As can be seen in FIG. 1, the dipole 16 itself is not fed, but contributes, as a mere passive element which has no connection of its own, via a field coupling to the resultant directional pattern, which is shown in FIG. 2.

As can be seen in FIG. 2, the antenna arrangement according to the present invention has the effect that the gain maximum 20 lies in the range of an elevation angle of 45°, as indicated by arrow 22 in FIG. 2. Furthermore, it can be seen from FIG. 2 that, in the range of an elevation angle of 45°, the gain maximum amounts to approx. 6 dBi, i.e. 6 dB as compared with an isotropic radiator. This guarantees an optimum reception of satellite signals. As can additionally be seen in FIG. 2, the gain of the antenna decreases in the direction of the surface area; in view of the fact that the terrestrial transmit signals, which impinge on the receiving antenna at an elevation angle of from 0° to 20°, have high received field strengths anyhow, this is, however, acceptable.

By varying the length of the dipole 16, e.g. between λ/2−25% and λ/2+25%, the absolute gain as well as the position of the gain maximum relative to the surface area, i.e. the elevation angle thereof, can be influenced and optimized, respectively.

In the case of an embodiment where the signals to be received by the antenna have a frequency of 2.34 GHz, i.e. a wavelength λ of 12.8 cm, the monopole 12 should, by way of example, be realized such that it has a length of 3.2 cm and the dipole such that it has a length of 6.4 cm.

In accordance with a preferred embodiment of the present invention, the antenna is realized by covering the monopole 12 and the dipole 16 with a coat of plastic material, this being common practice e.g. in the case of conventional monopole antennas for automobiles. Also the space between the monopole 12 and the dipole 16 can be guaranteed by plastic material, by way of example.

An antenna modification device according to the present invention is so conceived that an antenna for receiving satellite signals and terrestrial signals according to the present invention can be created from a conventional monopole antenna. For this purpose, the antenna modification device according to the present invention is provided with a dipole corresponding e.g. to the dipole 16 which is shown in FIG. 1. Furthermore, the antenna modification device includes a connection element (not shown) for connecting the dipole and the conventional monopole in such a way that they are related to one another in the manner described hereinbefore making reference to FIG. 1. The connection element may e.g. be a pin bushing or some other device which is suitable for securing an element comprising the dipole to the second end of a conventional monopole which is normally provided with a coat of plastic material. It follows that, according to the present invention, conventional monopole antennas can be upgraded so as to permit an interference-free reception of satellite signals. Hence, conventional monopole antennas need not be replaced completely by the antenna according to the present invention, but they can be upgraded by the antenna modification device according to the present invention, and this represents a substantial cost saving.

What is claimed is:

1. Antenna for receiving satellite signals and terrestrial signals, comprising:

a monopole having a first end, which is connected to a feeding point, and a second end; and an unfed dipole which is arranged in spaced relationship with the second end of the monopole and in axial alignment with said monopole and which contributes to the directional pattern of the antenna via a field coupling.

2. Antenna according to claim 1, wherein the monopole is a λ/4 monopole, λ being the wavelength of the signals to be received.

3. Antenna according to claim 2, wherein the dipole has a length in the range between λ/2−25% and λ/2+25%.

4. Antenna according to claim 1, wherein the monopole is arranged such that a conductive surface is arranged below the first end.

5. Antenna according to claim 1, wherein the feeding point is a coaxial connection.

6. Antenna according to claim 1, wherein the distance between said monopole and said dipole is smaller than λ/10, λ being the wavelength of the signals to be received.

7. Antenna modification device for modifying a monopole antenna having a first end, which is connected to a feeding point, and a second end, said antenna modification device comprising:

a dipole; and a connection element for connecting the dipole and the monopole such that the dipole is unfed and arranged in spaced relationship with the second end of the monopole as well as in axial alignment with said monopole, said dipole contributing to the directional pattern of the antenna via a field coupling.

8. Antenna modification device according to claim 7 for modifying a λ/4 monopole antenna, wherein the dipole has a length in a range between λ/2−25% and λ/2+25%, λ being the wavelength of the signal to be received.

9. Antenna modification device according to claim 8, wherein the connection element is implemented such that, when the dipole and the monopole have been connected, the distance between the monopole and the dipole is smaller than λ/10.

* * * * *